US006288626B1

(12) United States Patent
Cameron et al.

(10) Patent No.: US 6,288,626 B1
(45) Date of Patent: Sep. 11, 2001

(54) COMMON MODE CHOKE INCLUDING PARALLEL CONDUCTORS AND ASSOCIATED METHODS

(75) Inventors: Craig P. Cameron, Lyons, CO (US); Michael A. Bradley, Soddy Daisy; Richard W. Meadors, Chattanooga, both of TN (US)

(73) Assignee: Steward, Inc., Chattanooga, TN (US)

( * ) Notice: Subject to any disclaimer, the term of this patent is extended or adjusted under 35 U.S.C. 154(b) by 0 days.

(21) Appl. No.: 09/137,672

(22) Filed: Aug. 21, 1998

(Under 37 CFR 1.47)

(51) Int. Cl.[7] ..... H01F 5/00; H01F 27/28
(52) U.S. Cl. ..... 336/200; 336/223; 336/232; 336/83
(58) Field of Search ..... 336/200, 223, 336/232, 83

(56) References Cited

U.S. PATENT DOCUMENTS 5,945,902 * 8/1999 Lipkes et al. ..... 336/200
6,000,128 * 12/1999 Umeno et al. ..... 29/846

* cited by examiner

*Primary Examiner*—Anh Mai
(74) *Attorney, Agent, or Firm*—Allen, Dyer, Doppelt, Milbrath & Gilchrist, P.A.

(57) ABSTRACT

A common mode choke includes a plurality of joined together ferrite layers defining a generally rectangular body and comprising a bottom ferrite layer, a top ferrite layer, and at least one intermediate ferrite layer. The at least one intermediate ferrite layer preferably has an opening therein defining a cavity in the generally rectangular body extending from adjacent a first end thereof to adjacent a second end thereof. The choke also preferably includes at least one first pair of interior conductors extending on the at least one intermediate ferrite layer on opposite sides of the cavity. The choke may also include first and second pairs of end conductors on the first and second ends of the body that are connected to the interior conductors. The interior conductors may also have respective side edge portions exposed to the cavity in the body. In one embodiment, the opening in the at least one intermediate ferrite layer extends completely from the first end to the second end of the generally rectangular body. Air or another non-magnetic dielectric material may fill the cavity.

36 Claims, 6 Drawing Sheets

COMMON MODE CHOKE INCLUDING PARALLEL CONDUCTORS AND ASSOCIATED METHODS

FIELD OF THE INVENTION

This invention is related to the field of electronic devices, and more particularly to the field of ferrite inductors, such as for circuit board mounting.

BACKGROUND OF THE INVENTION

Chokes are commonly used in electronic circuits to block signal frequencies above a desired range, while at the same time allowing DC or low frequency signals to pass. Thus, chokes have been employed to prevent electromagnetic interference (EMI) from disturbing various electronic devices. EMI is generated, for example, as a byproduct of switching regulators which have current and voltage waveforms with fast rise and fall times. Because switching regulators are typically contained in power supplies, EMI may be transmitted through an electronic device via the power supply conductors. Excessive EMI can lead to logic errors in a computer and can cause interference with other adjacent electronic components. Of course, there are many other applications where a choke may be needed to filter unwanted signals.

A choke is typically provided by a magnetic core through which, or around which, conductors or windings are positioned. Thus, a typical choke defines first and second mutually coupled magnetic paths. A choke may be schematically represented by a low pass filter. For any choke to function as intended, its inductance or inductive reactance, should not fall below a specific minimum, even though the current in a winding rises to a maximum value. Beyond the maximum current value, the reactance falls off significantly. The choke's ability to impede interference signals drops, thereby allowing the passage of unwanted signals. It is therefore typically desirable to prevent a choke from being driven into such a saturation condition.

Ferrite materials are commonly used as the core material for many chokes because, for example, ferrites have sensitive magnetic-frequency relationships. The ferrite material used to form the choke will determine which signal frequencies the choke will attenuate. Most ferrites having suitable inductance values for choke applications saturate at less than about 4,000 Gauss. Accordingly, when configured differentially, ferrites have a relatively low current carrying capacity before the choke is driven into saturation and its impedance level deteriorates at the desired filter frequency.

The techniques normally used to prevent this saturation are to provide a core air gap, use a larger cross-section core, or simply to limit the allowable current. An example of a choke with a core having an air gap is illustrated in U.S. Pat. No. 5,455,552, assigned to the assignee of the present invention. The choke represents a significant advance in technology and includes a ferrite body through which a pair of spaced apart vertical slotted openings are formed. Pairs of spaced apart electrical conductors extend from the bottom of the device, vertically to the top of the device through one slot, along the top of the device, and back down vertically through the other slot of the device. The conductors are configured for common mode operation to mitigate the saturation difficulties. In other words, by bringing the high side and ground return through the same core opposing fields are produced in the core which tend to cancel.

While chokes are commonly applied directly to printed circuit boards, in such applications it is typically undesirable to use chokes with large cores or gapped sections. Accordingly, the compact ferrite structure as disclosed in U.S. Pat. No. 5,455,552 is advantageous for circuit board mounting. Unfortunately, the physical positioning of the discrete conductors through the vertically extending slots requires additional efforts during manufacturing.

SUMMARY OF THE INVENTION

In view of the foregoing background, it is therefore an object of the present invention to provide a common mode choke adapted for circuit board mounting and having desirable impedance and saturation characteristics while being readily manufacturable.

This and other objects, features and advantages in accordance with the present invention are provided by a common mode choke comprising a plurality of joined together ferrite layers defining a generally rectangular body and having a cavity therein. The device includes a bottom ferrite layer, a top ferrite layer, and at least one intermediate ferrite layer between the bottom and top ferrite layers. More particularly, the at least one intermediate ferrite layer preferably has an opening therein defining the cavity in the generally rectangular body extending from adjacent a first end to adjacent a second end of the body. The common mode choke also preferably includes at least one pair of interior conductors extending on the at least one intermediate ferrite layer on opposite sides of the cavity. In addition, the choke may also include at least one first pair of end conductors on the first end of the generally rectangular body, and at least one second pair of end conductors on the second end of the body also connected to the pair of interior conductors. Accordingly, the common mode choke is a monolithic device that can be readily connected to a circuit board, for example. In addition, the choke provides high common mode impedance and low differential mode impedance.

The at least one pair of interior conductors may also have respective side edge portions exposed to the cavity in the generally rectangular body. In other words, the interior conductors communicate with the cavity or are immediately adjacent the cavity. In one embodiment, the cavity is filled with air and the at least one pair of interior conductors are positioned inwardly from respective sides of the generally rectangular body to improve the performance of the common mode choke. The interior conductors may include enlarged width end portions which connect to the end conductors and also provide enhanced performance.

In one advantageous embodiment, the opening in the at least one intermediate ferrite layer extends completely from the first end to the second end of the generally rectangular body. Accordingly, the cavity opens outwardly at the first and second ends of the generally rectangular body, and ambient air will fill the cavity in one embodiment. In a variation of this embodiment, a solid non-magnetic dielectric body, such as aluminum oxide or titanium dioxide, may be positioned in the cavity.

In another embodiment of the common mode choke, the at least one intermediate ferrite layer includes respective end portions extending between the first and second ends of the generally rectangular body and adjacent portions of the opening. In other words, in this embodiment, the cavity is closed at the first and second ends of the generally rectangular body.

The at least one pair of interior conductors may comprise a pair of generally linearly extending electrically conductive layers arranged in side-by-side relation. The at least one intermediate ferrite layer may be provided by a pair of intermediate ferrite layers. Thus, the at least one pair of interior conductors are positioned between the pair of intermediate ferrite layers. In addition, in one variation each interior conductor comprises first and second electrically conductive layers in stacked and joined together relation. Accordingly, this common mode choke may carry higher currents and provide lower DC resistance. The top and bottom ferrite layers are preferably generally continuous.

A method aspect of the invention is for making the common mode choke. The method preferably comprises the steps of: joining together a plurality of ferrite layers comprising a bottom ferrite layer, a top ferrite layer, and at least one intermediate ferrite layer between the bottom and top ferrite layers; forming an opening in the at least one intermediate ferrite layer defining a cavity in the body extending from adjacent a first end thereof to adjacent a second end thereof; and forming at least one pair of interior conductors extending on the at least one intermediate ferrite layer on opposite sides of the cavity. The method also preferably includes the steps of forming at least one first pair of end conductors on the first end of the body and connected to the at least one first pair of interior conductors, and forming at least one second pair of end conductors on the second end of the body also connected to the at least one pair of interior conductors.

The step of forming the at least one pair of interior conductors preferably comprises forming same to have respective side edge portions exposed to the cavity in the body. In addition, the step of forming the at least one pair of interior conductors preferably comprises forming same to be positioned inwardly from respective sides of the body. The interior conductors may be formed to have enlarged width end portions. In one embodiment, the step of forming the opening comprises forming same to extend completely from the first end to the second end of the body so that the cavity opens outwardly at the first and second ends of the body. The method may further include the step of allowing the cavity to fill with air or positioning a non-magnetic dielectric body within the cavity.

DETAILED DESCRIPTION OF THE PREFERRED EMBODIMENTS

Figure 1:
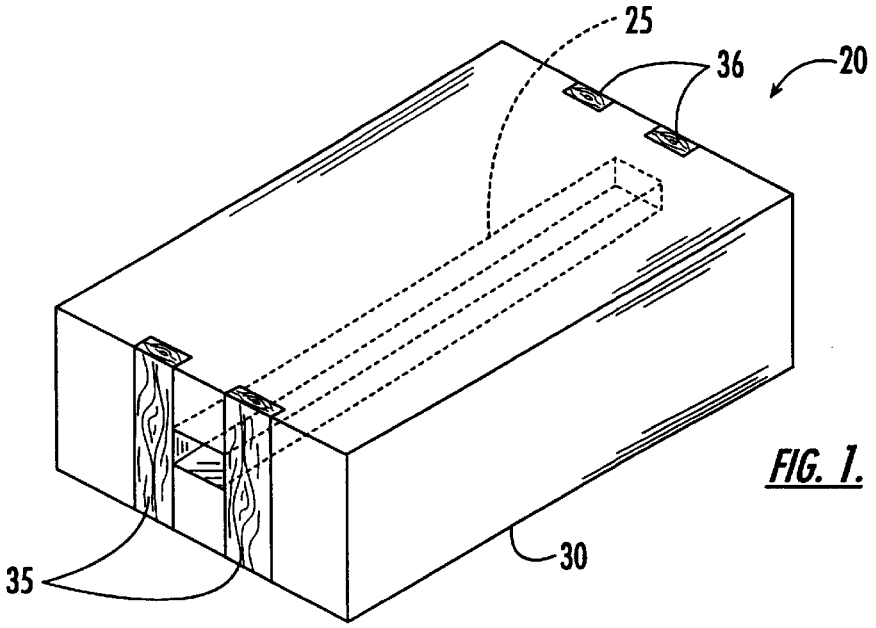
FIG. 1 is a perspective view of a first embodiment of the common choke in accordance with the present invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout, and prime and double prime notations are used to indicate like elements in alternate embodiments.

Referring initially to FIGS. 1–4 a first embodiment of the common mode choke 20 in accordance with the invention is described. The common mode choke 20 includes a plurality of joined together ferrite layers defining a generally rectangular body 30 and comprising a bottom ferrite layer 21, a top ferrite layer 22, and a pair of intermediate ferrite layers 23, 24 between the bottom and top ferrite layers. The intermediate ferrite layers 23, 24 have respective openings 26, 27 therein defining a cavity 25 in the generally rectangular body 30 extending from adjacent a first end thereof to adjacent a second end thereof as shown perhaps best in FIG. 1. The top and bottom ferrite layers 22, 21 are illustratively generally continuous. The top and bottom ferrite layers 22, 21 may also each have a thickness greater than a thickness of the intermediate layers 23, 24 as illustrated, although in other embodiments, the thicknesses may be the same, or the intermediate layers may be thicker than the top and bottom layers.

The common mode choke 20 also illustratively includes a pair of interior conductors 31, 32 extending in side-by-side relation along parallel generally linear paths on the lower intermediate ferrite layer 23 on opposite sides of the cavity 25. The choke 20 also includes a pair of first end conductors 35 on the first end of the generally rectangular body 30, and a pair of second end conductors 36 on the second end of the generally rectangular body connected to opposite ends of the pair of interior conductors 31, 32.

The interior conductors 31, 32 may be formed by screen printing a conductive paste as will be readily appreciated by those skilled in the art. The end conductors 35, 36 may be formed by various printing techniques as will also be readily appreciated by those skilled in the art. In addition, the ferrite layers are sintered to join the adjacent ferrite layers into a monolithic body. Accordingly, the common mode choke 20 is a monolithic device that can be readily connected to a circuit board, for example, by soldering the end conductors 35, 36 to the circuit board.

The pair of interior conductors 31, 32 are positioned inwardly from respective sides of the generally rectangular body 30 to improve the performance of the common mode choke. Another important aspect of the invention is that the pair of interior conductors 31, 32 also have respective side edge portions exposed to the cavity 25 in the generally rectangular body. Considered another way, the interior conductors are immediately adjacent the cavity 25. Another performance enhancing aspect of the interior conductors 31, 32 is that each may include respective end portions which have an increased width as shown in the illustrated embodiments. In the illustrated embodiment, the ends of the interior conductors 31, 32 taper outwardly.

Figure 2:
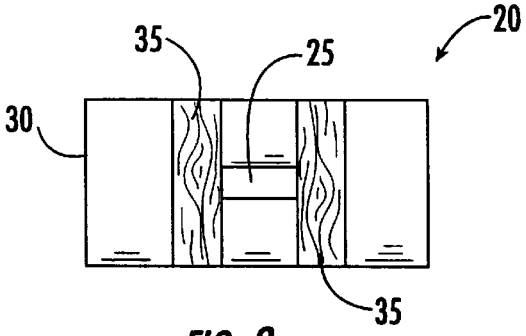
FIG. 2 is an end view of the common mode choke as shown in FIG. 1.

In the illustrated embodiment of FIG. 2, the cavity 25 is filled with air since the cavity extends completely from one end of the body 30 to the other, and the cavity opens outwardly at the opposing end faces of the body. The cavity 25 may be left open to thereby define an air gap in the body 30.

Figure 3:
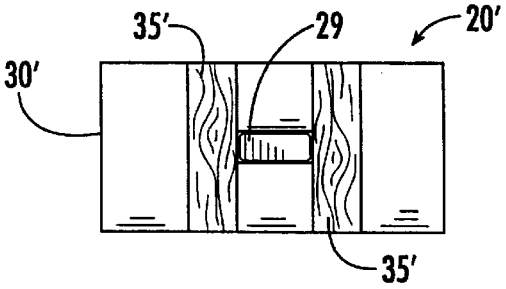
FIG. 3 is an end view of a variation of the common mode choke as shown in FIG. 1, but with a body of non-magnetic dielectric material within the cavity in the ferrite body.
Figure 4:
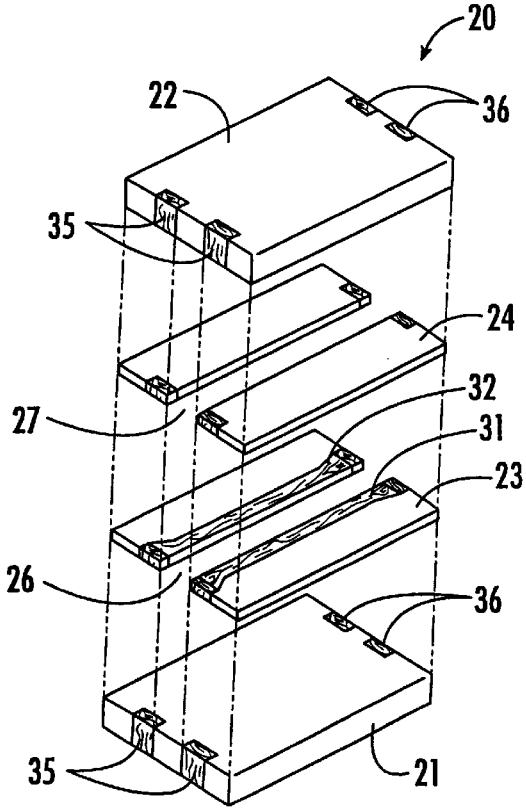
FIG. 4 is an exploded perspective view of the common mode choke as shown in FIG. 1.

In the variation shown in the end view of FIG. 3, the cavity 25 may be filled with a body 29 of non-magnetic dielectric material, such as, for example, a body of aluminum oxide or titanium dioxide. It is important, of course, not to electrically short the interior conductors to one another, and it is also important not to provide magnetic material in the area between the conductors. Those of skill in the art will appreciate other similar materials or combinations of materials that may be used to fill or at least partially fill the cavity 25.

Figure 5:
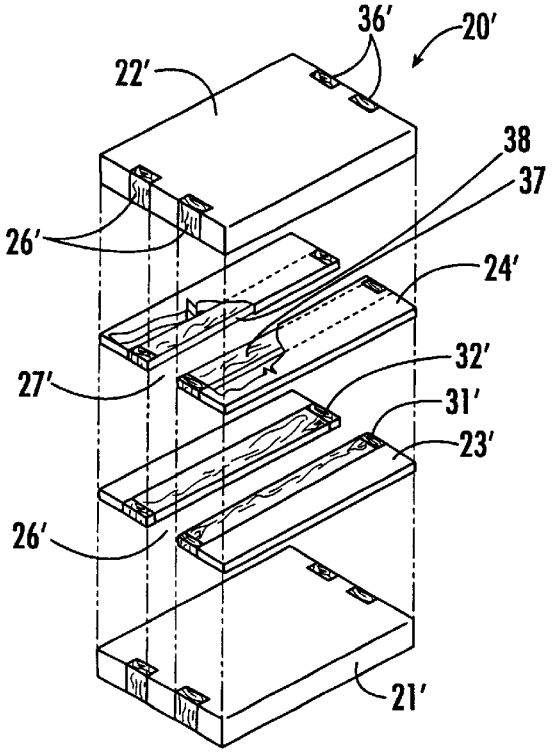
FIG. 5 is an exploded view of a variation of the common mode choke as shown in FIG. 1.

Turning now additionally to FIG. 5 a variation of the choke embodiment 20 shown in FIGS. 1–4 is now explained. Since the choke 20' may desirably carry a relatively large current, a second pair of conductors 37, 38 may be printed on the underside of the upper intermediate ferrite layer 24'. In other words, each interior conductor is formed by two conductive layers. Accordingly, the parallel conductive paths through the body 30' will have greater current handling capability, but be relatively straightforward to manufacture. In this embodiment, the interior conductors 31', 32' do not have the enlarged width end portions. The other elements of the choke 20' are indicated with prime notation and are similar to the elements already described, thereby requiring no further description.

Figure 7:
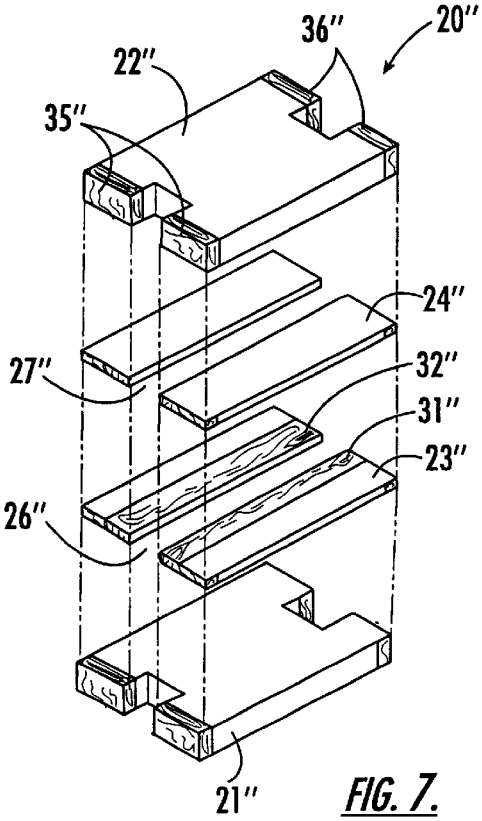
FIG. 7 is an exploded perspective view of the common mode choke as shown in FIG. 6.
Figure 6:
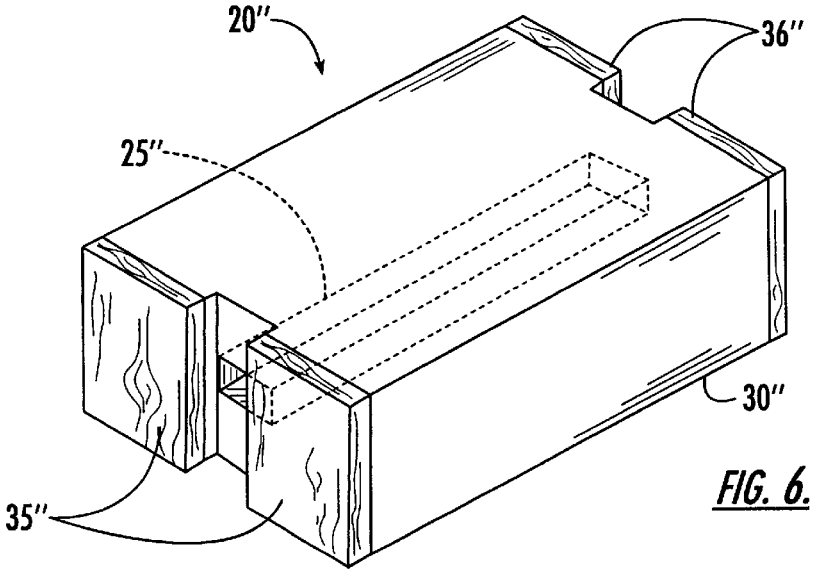
FIG. 6 is a perspective view of a second embodiment of the common mode choke in accordance with the invention.

Turning now to FIGS. 6 and 7, another embodiment of the common mode choke 20" in accordance with the present invention is described. In this embodiment, the end conductors 35", 36", and the top and bottom ferrite layers 22", 21", have a different configuration. More particularly, the top ferrite layer 22" and the bottom ferrite layer 21" have generally rectangular notches formed therein between the left and right ones of the end conductors. Accordingly, the end conductors 35", 36" are provided by caps covering corresponding projections in the body 30". The end conductors 35", 36" cover about half the length of the projections in the illustrated embodiment and may be also formed by various printing techniques as will be readily appreciated by those skilled in the art. The central cavity 25" opens outwardly at each end of the body 30". The other elements of this embodiment of the common mode choke 20" are similar to those described above and require no further description herein.

In the common mode choke embodiments 20, 20' and 20" described above, the cavities 25, 25' and 25" extend fully through the respective bodies 30, 30' and 30" and open outwardly at the ends of the devices. In the embodiments illustrated in FIGS. 8–11, the cavities are internally contained within the bodies. More particularly, as understood with reference to the common mode choke 60 illustrated in FIGS. 8 and 9, the intermediate ferrite layers 63, 64 each have generally rectangular central openings, 66, 67 which extend between opposing ends of the generally rectangular body 70. However, the intermediate ferrite layers 63, 64 include end portions which close the openings as shown in the illustrated embodiment.

Figure 8:
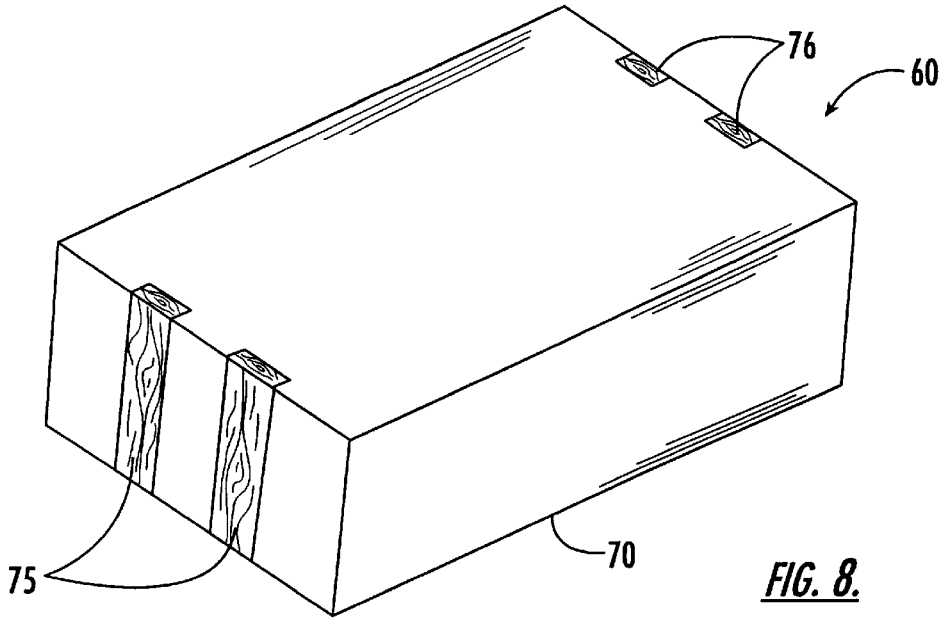
FIG. 8 is a perspective view of a third embodiment of the common mode choke in accordance with the present invention.
Figure 9:
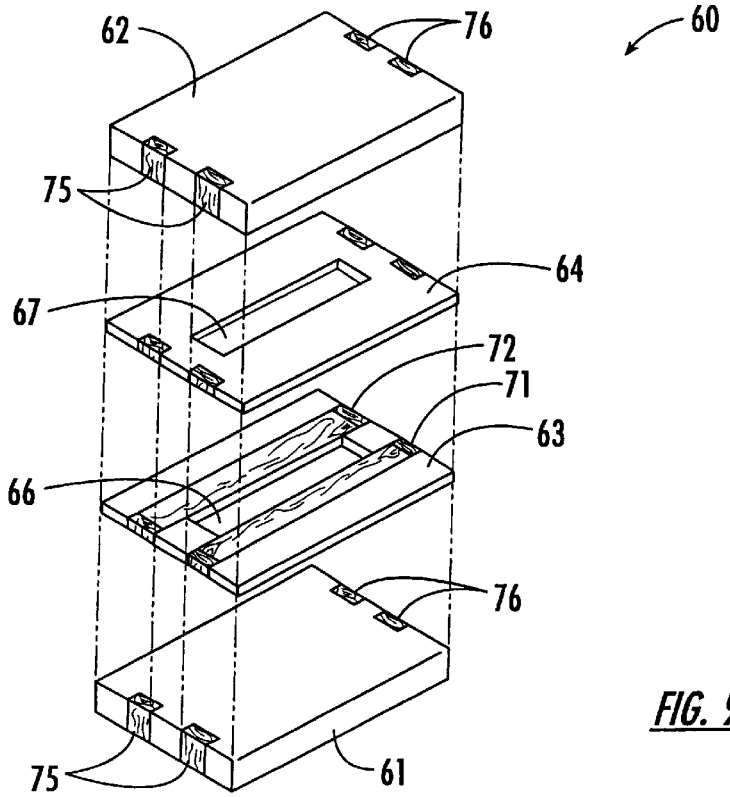
FIG. 9 is an exploded perspective view of the common mode choke as shown in FIG. 8.

The common mode choke 60 of FIGS. 8 and 9 also includes a first pair of vertically extending end conductors 75 and a second pair of end conductors 76 as described above with reference to the embodiments shown in FIGS. 1–5. In addition, the common mode choke 60 also includes the pair of internal conductors 71, 72 which extend on opposite sides of the cavity defined by the aligned openings 66, 67 and the side edges of the internal conductors 71, 72. The cavity may be filled with air, for example, by the passage of air through the somewhat porous ferrite layers as will be readily appreciated by those skilled in the art. Alternately, as described above, the cavity may be at least partially filled with a non-magnetic dielectric material.

Figure 10:
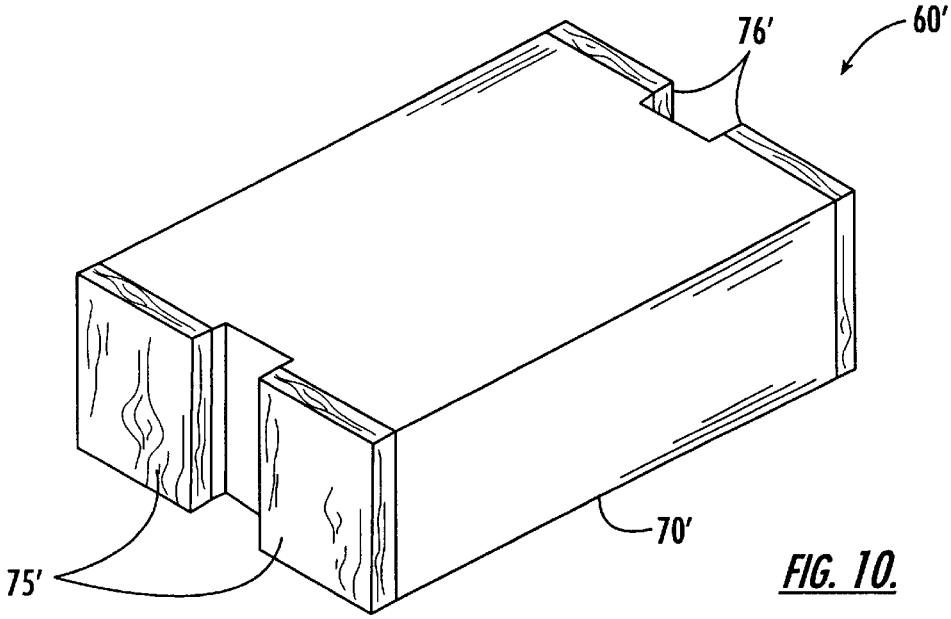
FIG. 10 is a perspective view of a fourth embodiment of the common mode choke in accordance with the present invention.
Figure 11:
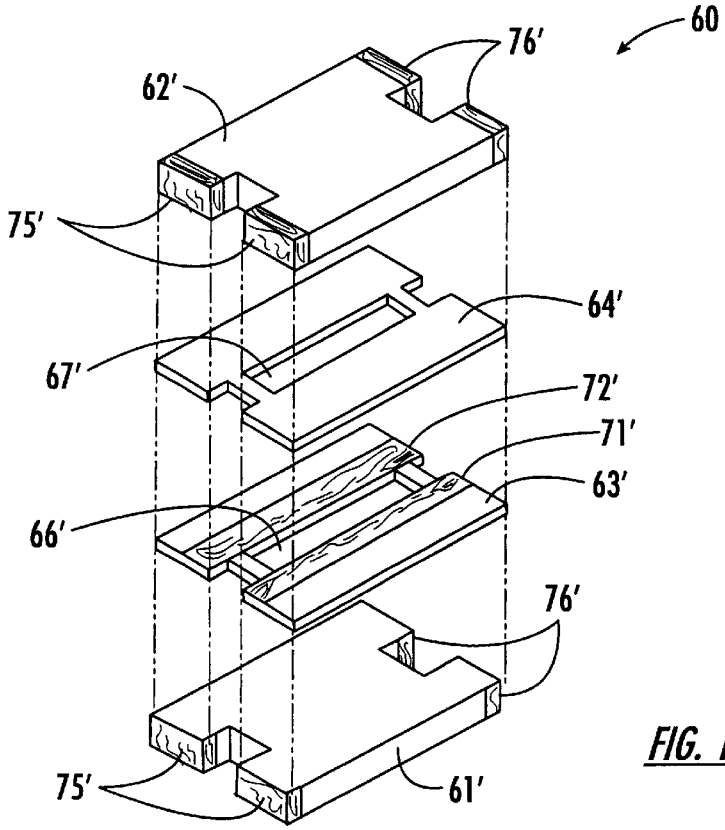
FIG. 11 is an exploded perspective view of the common mode choke as shown in FIG. 10.

FIGS. 10 and 11 illustrate another embodiment of the common mode choke 60' similar to that described above with reference to FIGS. 8 and 9, but with a different configuration of end conductors 75', 76'. In the illustrated choke 60', the end conductors 75', 76', and the top and bottom ferrite layers 22', 21', have a different configuration. The top ferrite layer 22' and the bottom ferrite layer 21' have generally rectangular notches formed therein between the end conductors. The end conductors 75', 76' define caps covering corresponding projections in the body 70'. The end conductors 75', 76' cover about half the length of the projections in the illustrated embodiment and may be formed by printing/plating techniques as will be readily appreciated by those skilled in the art. The central cavity is also closed within the body 70'. The other elements of this embodiment of the common mode choke 60' are similar to those described above with reference to FIGS. 8 and 9 and require no further description herein.

Having generally described the various structural features of the embodiments of the common mode chokes in accordance with the present invention, specific structures and performance characteristics are now described. In particular, examples based upon the embodiment of the common mode choke 20" as shown in FIGS. 6 and 7 will be further described. The choke 20" is a two-line common mode choke in the form of a solderable surface mount device as will be appreciated by those skilled in the art.

The ferrite material for the choke 20" may be a standard ferrite material in the form of a rolled and compacted tape as will be readily appreciated by those skilled in the art. The choke illustratively includes four ferrite layers, with the top and bottom layers 22", 21" being 0.052 inches and the intermediate layers 23", 24" being 0.0135 inches in one embodiment. The top and bottom layers, as well as the intermediate layers may have any desired thickness consistent with the circuit performance desired as will be readily understood by those skilled in the art. In addition, the various ferrite layers may be formed by other processes for forming layered ferrite structures as will also be readily understood by those skilled in the art.

The interior conductors 31", 321" may be formed using ferrite-doped silver conductive ink. To achieve a desired conductor thickness of about 0.003 to 0.005 inches, for example, multiple print and dry cycles may be needed. Alternately, a singled step of printing and drying may be used to form the desired conductor thickness. The openings 26", 27" in the intermediate ferrite layers 23", 24" may be punched to define the cavity 25" which provides a gap to stop the flow of magnetic flux as will be readily appreciated by those skilled in the art. The openings 26", 27" may be punched so that the openings intersect the interior conductors 31",32" defining the interior side edges thereof. After lamination, the chokes are cut, fired, tumbled, and terminated; the termination is fired and plated; and the device is tested.

Figure 12:
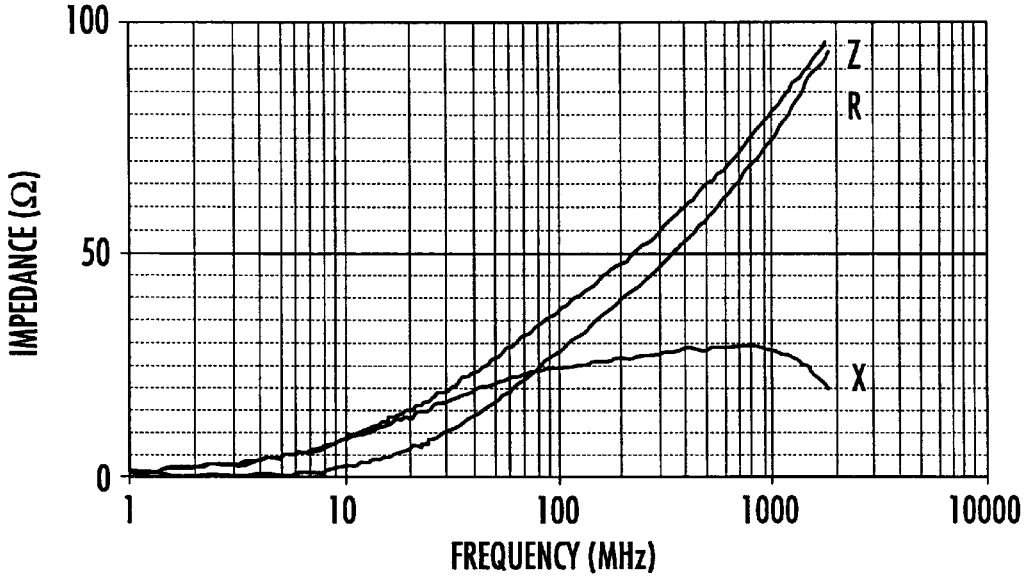
FIG. 12 is a graph of a first set of characteristics of a first example of a common mode choke in accordance with the invention.
Figure 13:
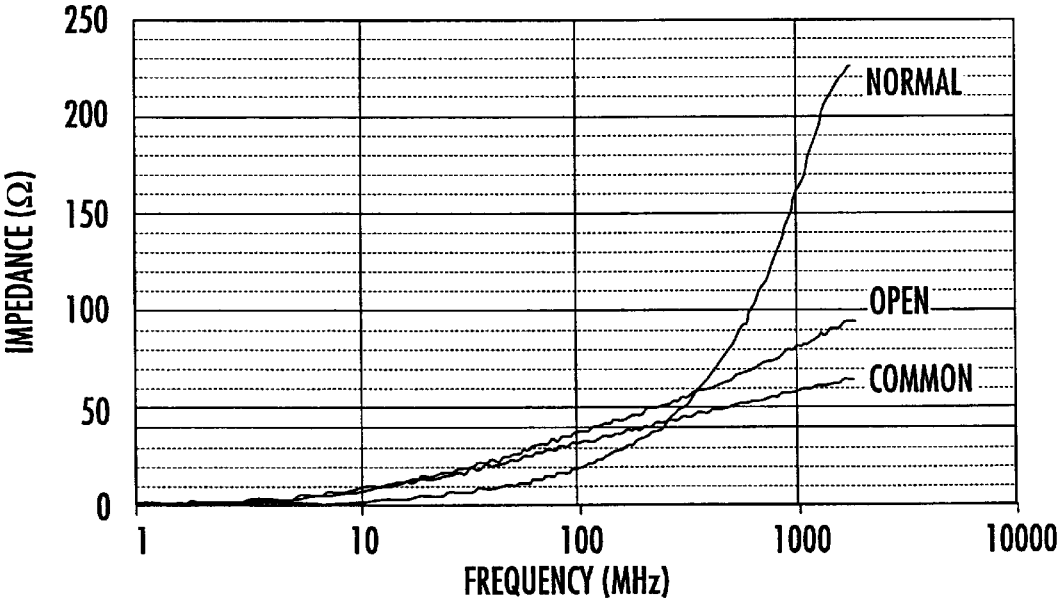
FIG. 13 is a graph of a second set of characteristics of the first example of a common mode choke in accordance with the invention.

The performance characteristics of a first size of common mode choke, having the configuration and design of FIGS. 6 and 7, are shown in FIGS. 12 and 13. The body has a length of 4.7 mm, a width of 5.6 mm, and a height of 2.85 mm. The plot labeled Z in FIG. 12 is the impedance versus frequency. The plot labeled R in FIG. 12 is the resistance versus frequency, and the plot labeled X is the inductive reactance versus frequency.

FIG. 13 shows the impedance versus frequency for three signal connection configurations. The plot labeled COMMON is for a common mode connection, the plot labeled OPEN is for a single leg of the choke, and the plot labeled NORMAL is for a normal connection of a signal out and back as will be readily appreciated by those skilled in the art. The impedance for the common mode configuration at 100 MHz is 33 Ω, at 500 MHz is 65 Ω, and at 1 GHz is 81 Ω. In addition, the maximum DC resistance is 0.015 Ω, and the choke can handle 7 amps of current.

Figure 14:
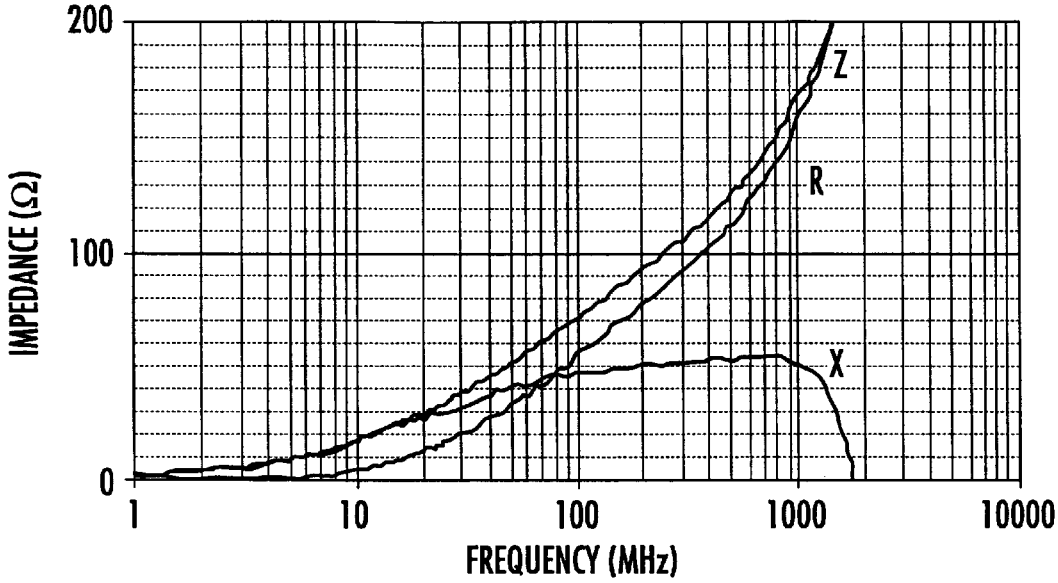
FIG. 14 is a graph of a first set of characteristics of a second example of a common mode choke in accordance with the invention.
Figure 15:
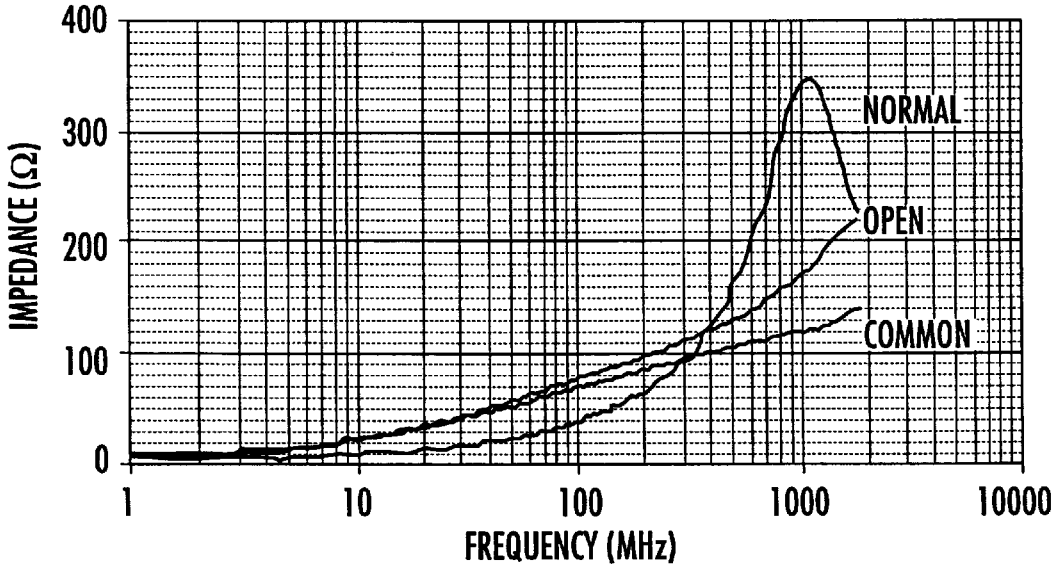
FIG. 15 is a graph of a second set of characteristics of the second example of a common mode choke in accordance with the invention.

FIGS. 14 and 15 show performance characteristics for a choke having a slightly greater length. More particularly, the length is 8.5 mm, while the width and height are the same as for the previous device. FIG. 14 and 15 show the same characteristics as described above and require no further description. Of interest, the larger device has an impedance of 60 Ω at 100 MHz, 127 Ω at 500 MHz, and 170 Ω at 1 GHz.

A method aspect of the invention is for making the common mode choke. The method preferably comprises the steps of: joining together a plurality of ferrite layers comprising a bottom ferrite layer, a top ferrite layer, and at least one intermediate ferrite layer between the bottom and top ferrite layers; forming an opening in the at least one intermediate ferrite layer defining a cavity in the body extending from adjacent a first end thereof to adjacent a second end thereof; and forming at least one first pair of interior conductors extending on the at least one intermediate ferrite layer on opposite sides of the cavity. The method also preferably includes the steps of forming at least one first pair of end conductors on the first end of the body and connected to the at least one first pair of interior conductors, and forming at least one second pair of end conductors on the second end of the body also connected to the at least one first pair of interior conductors.

The step of forming the at least one pair of interior conductors preferably comprises forming same to have respective side edge portions exposed to the cavity in the body. In addition, the step of forming the at least one pair of interior conductors preferably comprises forming same to be positioned inwardly from respective sides of the body. The interior conductors may be formed with enlarged width end portions.

In one embodiment, the step of forming the opening comprises forming same to extend completely from the first end to the second end of the body so that the cavity opens outwardly at the first and second ends of the body. In another embodiment, the cavity is contained within the body. The cavity may be filled with air, or may be at least partially filled with a body of non-magnetic dielectric material.

In the illustrated embodiments, single top and bottom layers have been described; however, those of skill in the art will appreciate that either or both of the top and bottom ferrite layers may be formed by several layers sintered together. In addition, although the common mode chokes have been described in terms of layers, it will be understood by those skilled in the art that the layers are typically not discrete after the sintering of the device. In other words, the adjacent layers fuse or join together. Although two intermediate ferrite layers have been described, one or more than two such layers may be used in other embodiments. More than one pair of internal conductors and their associated cavity may also be provided for multi-line choke embodiments. In addition, in other embodiments of the common mode choke, only a single end of the cavity may open outwardly, and the other end may be closed. Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A common mode choke comprising:

a plurality of joined together ferrite layers defining a generally rectangular body and comprising a bottom ferrite layer, a top ferrite layer, and at least one intermediate ferrite layer between the bottom and top ferrite layers, the at least one intermediate ferrite layer having an opening therein defining a cavity in the generally rectangular body extending from adjacent a first end thereof to adjacent a second end thereof;

at least one pair of interior conductors extending on the at least one intermediate ferrite layer on opposite sides of the cavity;

at least one first pair of end conductors on the first end of the generally rectangular body and connected to the at least one pair of interior conductors; and at least one second pair of end conductors on the second end of the generally rectangular body connected to the at least one pair of interior conductors.

2. A common mode choke according to claim 1 wherein the at least one pair of interior conductors have respective side edge portions exposed to the cavity in the generally rectangular body.

3. A common mode choke according to claim 1 wherein the at least one pair of interior conductors are positioned inwardly from respective sides of the generally rectangular body.

4. A common mode choke according to claim 1 wherein each interior conductor of the at least one pair of interior conductors has enlarged width end portions.

5. A common mode choke according to claim 1 wherein the at least one pair of interior conductors comprises a pair of generally linearly extending electrically conductive layers arranged in side-by-side relation.

6. A common mode choke according to claim 1 wherein the opening in the at least one intermediate ferrite layer extends completely from the first end to the second end of the generally rectangular body so that the cavity opens outwardly at the first and second ends of the generally rectangular body.

7. A common mode choke according to claim 1 wherein the at least one intermediate ferrite layer includes respective end portions extending between the first and second ends of the generally rectangular body and adjacent portions of the opening so that the cavity is closed at the first and second ends of the generally rectangular body.

8. A common mode choke according to claim 1 wherein the at least one intermediate ferrite layer comprises a pair of intermediate ferrite layers.

9. A common mode choke according to claim 8 wherein the at least one pair of interior conductors extend between the pair of intermediate ferrite layers.

10. A common mode choke according to claim 9 wherein each interior conductor of the at least one pair of interior conductors comprises first and second electrically conductive layers in stacked and joined together relation.

11. A common mode choke according to claim 1 wherein the top and bottom ferrite layers are generally continuous.

12. A common mode choke according to claim 1 wherein the cavity in the generally rectangular body is filled with air.

13. A common mode choke according to claim 1 wherein the cavity in the generally rectangular body is at least partially filled with a non-magnetic dielectric material.

14. A common mode choke comprising:

a plurality of joined together ferrite layers defining a generally rectangular body and comprising a bottom ferrite layer, a top ferrite layer, and at least one intermediate ferrite layer between the bottom and top ferrite layers, the at least one intermediate ferrite layer having an opening therein defining a cavity in the generally rectangular body extending completely from adjacent a first end thereof to adjacent a second end thereof so that the cavity opens outwardly at the first and second ends of the generally rectangular body; and at least one pair of interior conductors extending on the at least one intermediate ferrite layer on opposite sides of the cavity and having respective side edge portions exposed to the cavity in the generally rectangular body, the at least one pair of interior conductors being positioned inwardly from respective sides of the generally rectangular body.

15. A common mode choke according to claim 14 further comprising:

at least one first pair of end conductors on the first end of the generally rectangular body and connected to the at least one pair of interior conductors; and at least one second pair of end conductors on the second end of the generally rectangular body connected to the at least one pair of interior conductors.

16. A common mode choke according to claim 14 wherein each interior conductor of the at least one pair of interior conductors has enlarged width end portions.

17. A common mode choke according to claim 14 wherein the at least one pair of interior conductors comprises a pair of generally linearly extending electrically conductive layers arranged in side-by-side relation.

18. A common mode choke according to claim 14 wherein the at least one intermediate ferrite layer comprises a pair of intermediate ferrite layers.

19. A common mode choke according to claim 18 wherein the at least one pair of interior conductors extend between the pair of intermediate ferrite layers.

20. A common mode choke according to claim 19 wherein each interior conductor of the at least one pair of interior conductors comprises first and second electrically conductive layers in stacked and joined together relation.

21. A common mode choke according to claim 14 wherein the top and bottom ferrite layers are generally continuous.

22. A common mode choke according to claim 14 wherein the cavity in the generally rectangular body is filled with air.

23. A common mode choke according to claim 14 wherein the cavity in the generally rectangular body is at least partially filled with a non-magnetic dielectric material.

24. A common mode choke comprising:

a body comprising a plurality of joined together ferrite layers comprising a bottom ferrite layer, a top ferrite layer, and at least one intermediate ferrite layer between the bottom and top ferrite layers, the at least one intermediate ferrite layer having an opening therein defining a cavity in the body extending from adjacent a first end thereof to adjacent a second end thereof;

at least one pair of interior conductors extending on the at least one intermediate ferrite layer on opposite sides of the cavity;

at least one first pair of end conductors on the first end of the body and connected to the at least one pair of interior conductors; and at least one second pair of end conductors on the second end of the body connected to the at least one pair of interior conductors.

25. A common mode choke according to claim 24 wherein the at least one pair of interior conductors have respective side edge portions exposed to the cavity in the body.

26. A common mode choke according to claim 24 wherein the at least one pair of interior conductors are positioned inwardly from respective sides of the body.

27. A common mode choke according to claim 24 wherein each interior conductor of the at least one pair of interior conductors has enlarged width end portions.

28. A common mode choke according to claim 24 wherein the at least one first pair of interior conductors comprises a pair of generally linearly extending electrically conductive layers arranged in side-by-side relation.

29. A common mode choke according to claim 24 wherein the opening in the at least one intermediate ferrite layer extends completely from the first end to the second end of the body so that the cavity opens outwardly at the first and second ends of the body.

30. A common mode choke according to claim 24 wherein the at least one intermediate ferrite layer includes respective end portions extending between the first and second ends of the body and adjacent portions of the opening so that the cavity is closed at the first and second ends of the body.

31. A common mode choke according to claim 24 wherein the at least one intermediate ferrite layer comprises a pair of intermediate ferrite layers.

32. A common mode choke according to claim 31 wherein the at least one first pair of interior conductors extend between the pair of intermediate ferrite layers.

33. A common mode choke according to claim 32 wherein each interior conductor of the at least one pair of first interior conductors comprises first and second electrically conductive layers in stacked and joined together relation.

34. A common mode choke according to claim 24 wherein the top and bottom ferrite layers are generally continuous.

35. A common mode choke according to claim 24 wherein the cavity in the generally rectangular body is filled with air.

36. A common mode choke according to claim 24 wherein the cavity in the generally rectangular body is at least partially filled with a non-magnetic dielectric material.

* * * * *